US008950508B2

(12) United States Patent
Hoop et al.

(10) Patent No.: US 8,950,508 B2
(45) Date of Patent: Feb. 10, 2015

(54) HANDHELD POWER TOOL

(75) Inventors: Alexander Hoop, Schaan (LI); Hans Boeni, Werdenberg (CH); Dieter Profunser, Feldkirch (AT); Peter Brugger, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 697 days.

(21) Appl. No.: 13/304,439

(22) Filed: Nov. 25, 2011

(65) Prior Publication Data

US 2012/0132452 A1 May 31, 2012

(30) Foreign Application Priority Data

Nov. 26, 2010 (DE) ..... 10 2010 062 014

(51) Int. Cl.
*B25B 21/02* (2006.01)
*B25D 16/00* (2006.01)

(52) U.S. Cl.
CPC ..... *B25B 21/02* (2013.01); *B25B 21/026* (2013.01)
USPC ..... 173/93.5; 173/93; 173/104; 173/128; 173/205; 192/56.62

(58) Field of Classification Search
USPC ..... 173/48, 93, 93.5, 93.6, 104, 109, 128, 173/178, 205; 192/56.62, 48.6, 56.1, 223.2
See application file for complete search history.

(56) References Cited

U.S. PATENT DOCUMENTS 2,111,280 A * 3/1938 Connell ..... 173/93.6
2,753,965 A * 7/1956 Kaman ..... 173/93.6
2,907,240 A * 10/1959 Schwenk et al. ..... 173/93.6
2,940,565 A * 6/1960 Schodeberg ..... 173/93.6
3,369,615 A * 2/1968 Maffey, Jr. et al. ..... 173/93.6
3,387,669 A * 6/1968 Wise, Jr. et al. ..... 173/176
3,450,214 A * 6/1969 Bangerter et al. ..... 173/178
4,085,337 A * 4/1978 Moeller ..... 307/115
4,712,456 A * 12/1987 Yuan ..... 81/473
5,673,758 A * 10/1997 Sasaki et al. ..... 173/178
5,836,403 A * 11/1998 Putney et al. ..... 173/205
5,992,538 A * 11/1999 Marcengill et al. ..... 173/93
6,138,772 A 10/2000 Miescher et al. ..... 173/93.5
6,142,242 A * 11/2000 Okumura et al. ..... 173/48
6,158,526 A * 12/2000 Ghode et al. ..... 173/93
6,223,834 B1 * 5/2001 Takamura et al. ..... 173/93.5
6,457,535 B1 * 10/2002 Tanaka ..... 173/48
7,048,075 B2 * 5/2006 Saito et al. ..... 173/93.5
7,588,093 B2 * 9/2009 Grand et al. ..... 173/29
7,658,238 B2 * 2/2010 Toukairin et al. ..... 173/178
7,658,239 B2 * 2/2010 Klemm et al. ..... 173/178
7,806,198 B2 * 10/2010 Puzio ..... 173/1
7,861,797 B2 1/2011 Hartmann et al. ..... 173/178
7,918,286 B2 * 4/2011 Nagasaka et al. ..... 173/93

FOREIGN PATENT DOCUMENTS

DE 198 21 554 B4 11/1999
EP 1 862 265 A2 12/2007

* cited by examiner

*Primary Examiner* — Scott A. Smith
(74) *Attorney, Agent, or Firm* — Davidson, Davidson & Kappel, LLC

(57) ABSTRACT

A handheld power tool, including a tool socket on a drive shaft for purposes of holding a tool, the drive shaft executing a rotating and partially tangentially striking movement using a tangential striking mechanism drivable by a drive. The tangential striking mechanism has an anvil associated with the drive shaft and a hammer associated with the drive, movable with respect to each other so as to strike each other axially when under the effect of the force of at least one first spring, and to strike each other tangentially when the anvil and the hammer are rotated. The hammer has a main mass, and an extra mass that is under the effect of a second spring couplable to the main mass.

15 Claims, 5 Drawing Sheets

HANDHELD POWER TOOL

This claims the benefit of German Patent Application DE 10 2010 062 014.9, filed Nov. 26, 2010 and hereby incorporated by reference herein.

The invention relates to a handheld power tool.

BACKGROUND

A mechanical tangential striking mechanism such as the one used in a handheld power tool of the above-mentioned type, for instance, in an impact screwdriver, allows the generation of relatively large torques on the tool socket, whereby only a relatively small counter-torque is needed. This is advantageous, for example, when screwed connections are being tightened or when screw anchors are being set into a very hard substrate. In particular, it is an option in such applications for the peak torque that can be provided by the tangential striking mechanism to be far higher than the continuous torque that can be provided by the drive of the handheld power tool. The lowest possible counter-torque is especially advantageous for users since they normally have to exert the counter-torque onto the handle of the handheld power tool such as, for example, an impact screwdriver. The lower the counter-torque, the simpler the handling of the handheld power tool.

For the most part, tangential striking mechanisms within the scope of a spring-mass system are designed for the resonant operation of such a system, which usually restricts the effective operation to a relatively limited torque range. Ultimately, the actual operating point of the handheld power tool within the relatively narrowly limited torque range is defined by the rotational speed of the drive of the handheld power tool.

Before the above-mentioned backdrop, it is desirable to achieve the largest possible torque range within which the handheld power tool can be effectively operated. It has been found that, for this purpose, a tangential striking mechanism of the handheld power tool—similar to a spring-mass system—can be adapted for resonant operation. For instance, German patent DE 198 21 554 B4 discloses a handheld power tool with a cam striking mechanism in which a cam disk arranged non-rotatably in the housing of the handheld power tool can be axially moved against the force of a first spring, and if necessary, also against the force of a second spring that can be coupled on. This makes it fundamentally possible to increase the striking strength of the cam striking mechanism.

A problematic aspect of the adaptation of a tangential striking mechanism—which can be basically structured as a spring-mass system like the friction clutch of European application EP 1 862 265 A2—is that any change in the spring force for the mass of the hammer in the tangential striking mechanism also leads to a change in the striking frequency, which is perceptible to the user. If an impact screwdriver is being used, this naturally also influences the tightening of screws or the setting of anchors. Moreover, an increase in the spring force, for example, not only causes an increase in the striking force, but also causes the tangential striking mechanism to have a higher triggering torque, which means that the user has to apply a corresponding counter-torque onto the handle. This has a detrimental effect on the handling of the handheld power tool. In particular, a relatively low holding torque is especially desirable since this is an essential benefit of an impact screwdriver with a tangential striking mechanism in comparison to, for instance, a conventional screwdriver. In the case of the striking mechanism adaptations known so far, it has also proven to be necessary to regularly adapt the rotational speed of the motor to the adapted conditions of the striking mechanism in order to attain an effective operating point within the useful and adapted torque range.

SUMMARY OF THE INVENTION

It is an object of the present invention to provide a handheld power tool with which the useful torque range can be adapted in an improved manner. In particular, the adaptation of a tangential striking mechanism should be improved. Especially preferably, the adapted torque range should translate into an overall larger useful torque range.

The present invention provides a handheld power tool. According to the invention, the hammer of the tangential striking mechanism has a main mass, whereby the tangential striking mechanism additionally provides an extra mass that can be detachably coupled to the main mass and that is exposed to the force of a second spring. Coupling the extra mass to the main mass thus constitutes a hammer whose total weight is made up of the sum of the main mass and the extra mass. Whenever necessary, this increases the torque of the tangential striking mechanism that can be generated in accordance with the concept of the invention. Furthermore, the concept of the invention also provides that the extra mass is exposed to the force of a second spring. This increases not only the total weight of the hammer but also the total spring force to which the spring-mass system of the tangential striking mechanism is exposed. As a result, the striking frequency of the tangential striking mechanism is kept constant in operating states involving an increased total weight consisting of the main mass and the extra mass and at an increased total spring force, as well as in other operating states in which only a main mass is exposed to the force of the first spring. The concept of the invention allows the torque that the tangential striking mechanism can generate to be adapted, and advantageously increased, especially in the second operating state involving an increased total weight of the hammer, but this only comes at the expense of a slight increase in the triggering torque of the tangential striking mechanism. The holding torque for the user is thus kept relatively small in spite of the increase in or adaptation of the generated torque. The reason for this is that, according to the concept of the invention, an increase in the spring force for the tangential striking mechanism resulting from the increased total weight in the second operating state can end up being relatively small. Advantageously, a user will thus hardly notice a change in the holding torque when using the handheld power tool when the tangential striking mechanism is adapted. Nevertheless, the user will be able to adapt the torque that the handheld power tool can generate to the required operating circumstances.

The concept of the invention also entails the advantage that, owing to the largely constant striking frequency when the tangential striking mechanism is adapted, the rotational speed of the motor can likewise remain largely constant. This advantageously allows an improved configuration of the drive for a first operating state involving the hammer with only its main mass as well as for a second operating state involving the hammer with an increased total weight. In any case, if an unregulated motor is employed to drive the handheld power tool, the rotational speed of the motor can likewise be adapted as a function of the load when the tangential striking mechanism is adapted.

Within the scope of a particularly advantageous refinement of the handheld power tool, it can be operated in a first as well as a second operating state, whereby it is possible to switch back and forth between the above-mentioned operating states as the need arises. Advantageously, in a first operating state, the main mass of the hammer and the anvil can be moved with respect to each other so as to strike each other axially when they are only under the effect of the force of a first spring, and so as to strike each other tangentially when the main mass is rotated. Advantageously, in a second operating state, the main mass and the extra mass of the hammer and the anvil can be moved with respect to each other so as to strike each other axially when they are under the effect of the force of the first and second springs, and so as to strike each other tangentially when the main mass is rotated.

In an especially preferred structural refinement of the concept of the invention, it is provided that the extra mass can be detachably coupled to the main mass by means of a coupling mechanism. Advantageously, the coupling mechanism has a pre-tensioned second spring that acts upon the extra mass. The coupling mechanism can advantageously be actuated by the user of the handheld power tool, so that during the operation of the handheld power tool, it is possible to switch over between the first and second operating states by actuating the coupling mechanism. Thanks to the pre-tensioned second spring that advantageously is already acting upon the extra mass in the coupling mechanism, the adaptation of the tangential striking mechanism involving an increased total weight and increased spring force can be configured in a relatively simple and efficient manner.

Advantageous embodiments of the invention can be gleaned from the subordinate claims and they give an in-depth presentation of advantageous ways to realize the above-mentioned concept within the scope of the envisaged objective as well as in terms of additional advantages.

Advantageously, it is provided that the coupling mechanism can be moved along a guiding link. For example, the coupling mechanism can be moved by the user. For this purpose, the coupling mechanism can advantageously be moved axially along a guiding link. The coupling mechanism can also be rotated along a guiding link. Both approaches are possible on their own or in combination, for instance, in order to switch over between the above-mentioned first and second operating states of the handheld power tool.

Advantageously, in a second operating state, the main mass and the extra mass are coupled to each other with a positive fit. This has proven to be a relatively simple way to increase the total weight of the hammer.

In an advantageous structural refinement, the coupling mechanism has a housing cage in which the above-mentioned second spring is pre-tensioned against the extra mass and the housing cage. Such a housing cage can advantageously be moved freely in its entirety or along a guiding link. The coupling mechanism thus has an integrally compact shape that can be reliably actuated.

Advantageously, in a first operating state, a securing element secures the coupling mechanism against moving. A securing element advantageously serves to prevent unintentional actuation of the coupling mechanism. The securing element can be configured to secure the coupling mechanism for the operation of the handheld power tool in the first operating state as well as in the second operating state. For instance, a securing element can be configured as a lever collar or the like, against whose resistance the coupling mechanism has to be actuated, or that has to be actuated by the user prior to the actuation of the coupling mechanism.

It has proven to be fundamentally advantageous for the tangential striking mechanism to be provided with a structurally suitable force-transmitting striking drive that acts upon the hammer and/or the anvil. A striking drive advantageously serves to move the hammer and/or the anvil with respect to each other along a guiding contour so as to strike each other axially, and so as to strike each other tangentially when the guiding contour is rotated. The hammer and/or the anvil advantageously have a striking surface by means of which a tangential impact can be transmitted in order to transmit a peak torque between the hammer and the anvil. For example, the striking drive in the form of a link guide can be configured with a threaded guiding contour that is formed on a spindle that couples the drive and the hammer. The striking drive can also be configured in the form of an array of studs having a slanted guiding contour that is formed on a cam that couples the hammer and the anvil. Other forms of a striking drive are also possible and they are not restricted to the above-mentioned advantageous embodiments.

Within the scope of an especially preferred first refined variant of the invention, it is provided that the extra mass has a striking surface that, when the extra mass and the main mass are coupled together, extends axially up to or beyond the extension of the main mass. In this variant, the striking surface of the extra mass is configured alone or additionally so as to strike against an anvil striking surface in order to transmit a tangential impact. This can be utilized to design the striking surface of the extra mass over a larger surface area so as to stress the extra mass to a lesser degree when the tangential impact is being exerted.

In a likewise particularly preferred second refined variant of the invention, it is provided that the main mass has a striking surface that, when the extra mass and the main mass are coupled together, extends axially beyond the extension of the extra mass. In this refined variant, the striking surface of the main mass is configured only to strike against an anvil striking surface. This second variant can advantageously be utilized to configure the striking surfaces, especially the anvil striking surface, to be relatively small. This can advantageously be utilized to reduce the total weight of the tangential striking mechanism.

BRIEF DESCRIPTION OF THE DRAWINGS

Embodiments of the invention will now be described on the basis of the drawing. The drawing does not necessarily depict the embodiments true-to-scale, but rather, the drawing is presented in schematic and/or slightly distorted form whenever necessary for the sake of clarity. Regarding additions to the teaching that can be gleaned directly from the drawing, reference is hereby made to the pertinent state of the art. In this context, it should be taken into account that a wide array of modifications and changes pertaining to the shape and the detail of an embodiment can be made, without deviating from the general idea of the invention. The features of the invention disclosed in the description, in the drawing as well as in the claims, either on their own or in any desired combination, can be essential for the refinement of the invention. Moreover, all combinations of at least two of the features disclosed in the description, in the drawing and/or in the claims fall within the scope of the invention. The general idea of the invention is not limited to the exact shape or details of the preferred embodiment shown and described below, nor is it limited to an object that would be restricted in comparison to the subject matter claimed in the claims. Regarding the dimensional ranges given, values that fall within the cited limits can also be disclosed as limit values and can be employed and claimed as desired. For the sake of simplicity, the same reference numerals will be used below for identical or similar parts or for parts having an identical or similar function.

Additional advantages, features and details of the invention ensue from the description below of preferred embodiments as well as from the drawing; this shows the following.

DETAILED DESCRIPTION

Figure 1:
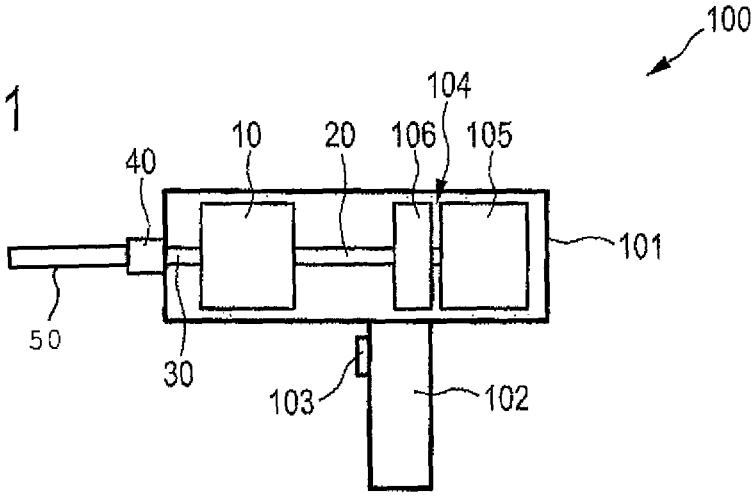
FIG. 1: a schematic depiction of a handheld power tool having one tangential striking mechanism according to the concept of the invention.

FIG. 1 shows a handheld power tool 100 which, for example, in the form of an impact screwdriver, can be held by a handle 102 formed on the housing 101, and whose drive 104 here can be activated with a trigger 103 in the form of a lever or a pushbutton. The drive 104 here is a motor 105 in the form of an electric motor that transfers a rotational movement indicated in FIG. 1 to a spindle 20 by means of a drive 106. By means of the tangential striking mechanism 10 described in greater detail in FIG. 2, the rotational movement 1 of the spindle 20 is converted into a partially tangentially striking movement of the drive shaft 30; this rotating and partially tangentially striking movement of the drive shaft 30 is transferred to a tool 50 (shown schematically) in a tool socket of the handheld power tool 100. The tool 50, for example, a screwdriver or the like, which is installed in the tool socket 40 on the same axis 2 as the spindle 20 and the drive shaft 30, is thus capable of transferring greater torques onto, for example, a screw, than can be done with the continuous torque output of the motor 105. The tangential striking mechanism 10 can be modeled in accordance with a simple spring-mass system and is operated here in the resonant range, which optimizes the torque peak transfer onto the tool and the screw. A preferred application for such an impact screwdriver is, for instance, to screw in screws or to set anchors into concrete or into a similar hard substrate.

Figure 2A:
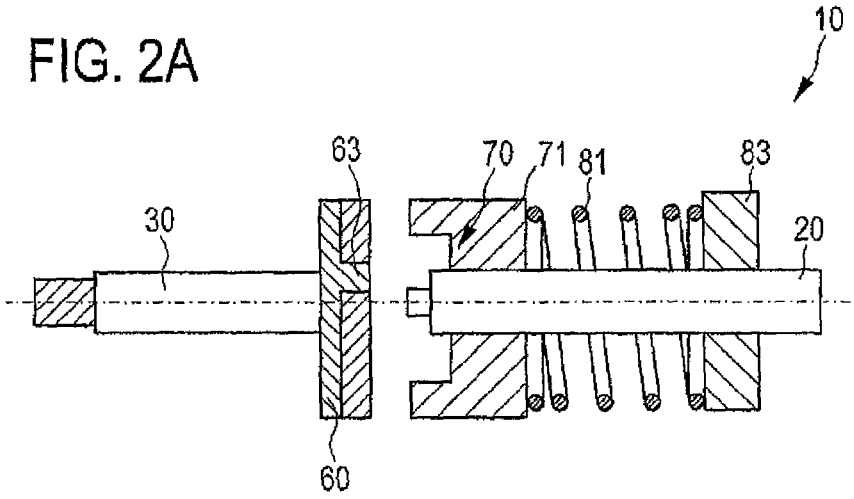
FIG. 2A, 2B: a tangential striking mechanism for a handheld power tool according to FIG. 1, in a first operating state or in a second operating state, the latter with an increased total weight of the hammer and increased spring force of the tangential striking mechanism, for purposes of elucidating the concept of the invention.
Figure 2B:
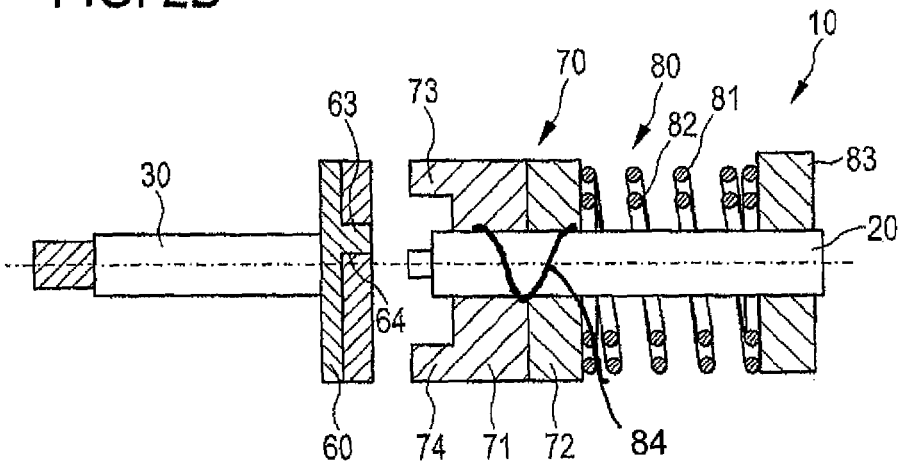

FIGS. 2A and 2B schematically show the mode of functioning of an adaptive tangential striking mechanism 10, whereby FIG. 2A shows the adaptive tangential striking mechanism 10 in a first operating state, while FIG. 2B shows the adaptive tangential striking mechanism 10 in a second operating state. The adaptive tangential striking mechanism 10 which, for the sake of simplicity, will also be referred to below as the tangential striking mechanism, has an anvil 60 associated with the drive shaft 30 as well as a hammer 70 associated with the drive 104. In FIG. 2A, for the sake of simplicity, the hammer 70 is depicted only with its main mass 71. In the setting of the adaptive tangential striking mechanism 10 that characterizes the first operating state, the main mass 71 of the hammer 70 can be moved so as to strike the anvil 60 axially only under the effect of the force of a first outer spring 81, and can be moved so as to strike the anvil 60 tangentially when the main mass is rotated. The first—outer—spring 81 is part of a spring system 80 shown in greater detail in FIG. 2B. The first, outer spring 81 rests against a fixed stop 83 and is thus pre-tensioned relative to the main mass 71 of the hammer 70. The first outer spring 81 has a first spring constant K1 that is defined by its stiffness. The main mass 71 of the hammer 70 has a weight designated by the reference numeral M1.

According to the concept of the invention, the adaptive tangential striking mechanism 10 can also be brought into a second operating state depicted in FIG. 2B, in which state the torque that can be generated is increased while the natural frequency of the spring-mass system consisting of the hammer 70 and the spring system 80 remains largely constant. Towards this end, an extra mass 72 is additionally coupled with a positive fit to the main mass 71 of the hammer 70. The weight of the extra mass 72 is designated here by the reference numeral M2. Therefore, the total weight of the hammer 70 in the second operating state shown in FIG. 2B is M1+M2. The hammer 70, provided with this total weight, is under the effect of the force of the spring system 80 which, in addition to the first, outer spring 81, now has a second spring 82 running inside the outer spring. The spring constant K2 of the second spring 82 is defined by its stiffness and can be greater or smaller than the stiffness of the first spring 81. Consequently, whenever necessary—like the weight M2 of the extra mass 72—a spring constant K2 can be configured in order to keep the natural frequency of the spring-mass system consisting of the hammer 70 and the spring system 80 largely constant in the second operating state in comparison to the first operating state.

The two springs 81, 82, in turn, rest against the stop 83. In the second operating state shown in FIG. 2B, the sum of the weights of the main mass 71 and the extra mass 72 of the hammer 70 is exposed to the force of the first and second springs 81, 82 so that the hammer 70 can be moved so as to strike the anvil 60 axially, and so as to strike the anvil 60 tangentially when the main mass is rotated. The hammer 70—here symbolically depicted by the main mass 71—has hammer cams 73 that are provided to strike against associated anvil cams 63, which are likewise symbolically depicted here. For purposes of transmitting a peak torque in case of a tangential impact, a hammer cam 73 has a striking surface 74 positioned perpendicular to the circumferential direction of the hammer 70. By the same token, an anvil cam 63 can also have a striking surface 64 associated with the striking surface 74. The striking surface can also be directly on the body of the anvil 60.

The axial and rotating movements of the hammer 70 are achieved here by means of a striking drive in the form of a link guide located on the spindle 20. The link guide 84 (shown schematically) has a threaded guiding contour (also shown schematically) that forces the hammer 70 with its main mass 71 and 72 to execute a rotating movement as it advances axially towards the anvil 60, a process in which the movement is driven by the spring system 80.

Figure 3A:
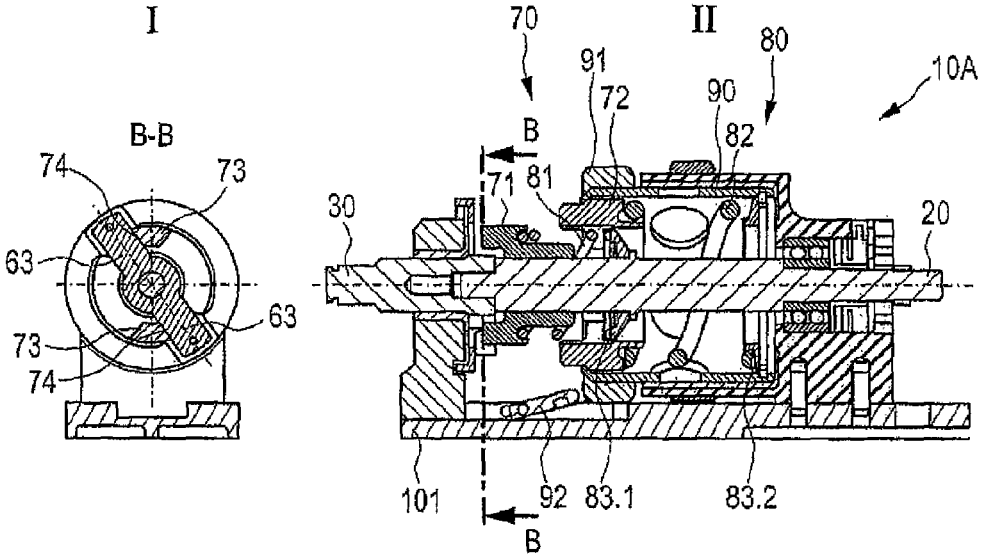
FIG. 3A, 3B: a first, structurally implemented preferred embodiment of a tangential striking mechanism according to the first refined variant of the invention, in an axial view and in a cross sectional view as well as for a first and second operating state.
Figure 3B:
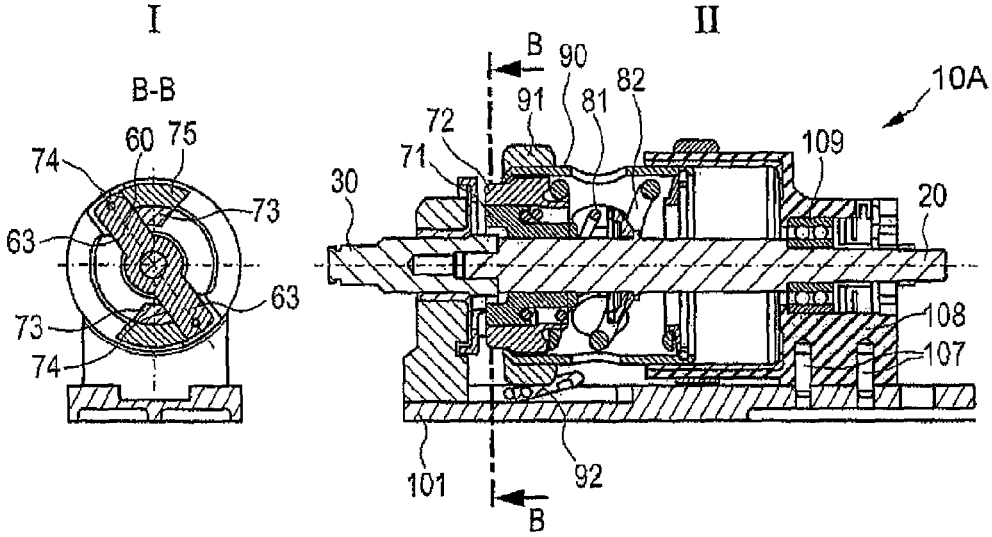

In a cross section I and in an axial section II, FIGS. 3A, 3B each show the operating states already elaborated on in FIGS. 2A, 2B of a tangential striking mechanism 10A according to an especially preferred first embodiment of the first refined variant of the invention. For the sake of simplicity here, the same reference numerals as in FIGS. 2A, 2B are used for identical or similar parts or for parts having an identical or a similar function. The mode of functioning of the first variant of the adaptive tangential striking mechanism 10A corresponds to the mode of functioning as was explained on the basis of FIGS. 2A, 2B. Below, special reference is made to the structural details of the tangential striking mechanism 10A and, for the rest, to the description of FIGS. 2A, 2B.

In the embodiment shown in FIGS. 3A, 3B, the tangential striking mechanism 10A has a main mass 71 with the weight M1=130 g, and an extra mass 71 with the weight M2=160 g. Therefore, the extra mass 72 here has a greater weight than the main mass 71. In the first operating mode shown in FIG. 3A, the tangential striking mechanism 10A is operated only with the main mass 71, which is moved so as to strike the anvil 60 axially when it is only under the effect of the force of the first spring 81, and moved so as to strike the anvil 60 tangentially when the main mass 71 is rotated. The corresponding cam 73 of the main mass 71 can be seen in the cross-sectional view I of FIG. 3A at the moment of the tangential impact against a cam 63 of the anvil 60, that is to say, the body of the anvil 60. The moment of inertia of the main mass 71 is about 40,000 $gmm^2$ here. The moment of inertia $I_2$ of the extra mass 72 is about 100,000 $gmm^2$ here. The spring stiffness K1 of the first spring 81 is about 11 kN/m here. The spring stiffness K2 of the second spring 82 is 36 kN/m here. In the second operating state shown in FIG. 3B, the weights M1, M2 of the main mass 71 and of the extra mass 72 add up to the total weight M1+M2 of the hammer 70. By the same token, the spring stiffness values K1, K2 of the first and second springs add up to a total spring stiffness K1, K2 of the spring system 80. Due to the likewise cumulative moments of inertia $I_1$, $I_2$, the tangential striking mechanism 10A in the second operating state shown in FIG. 3B has a considerably greater torque that can be transmitted. Nevertheless, the resonantly operable natural frequency of the spring-mass system of the adaptive striking mechanism 10A in the second operating state corresponds largely to that of the first operating state. Therefore, the impact frequency of the tangential striking mechanism 10A that can be effectively selected remains largely the same even though the transmittable torque has been increased.

For purposes of implementing the coupling and uncoupling of an extra mass 72 to the second spring 82, a housing cage 90 that is rotatably mounted and freely movable along the spindle 20 spindle is implemented. The housing cage 90 is rotatably mounted and freely movable axially along a guide link. In other words, when the control wheel 91—which is permanently joined to the housing cage and which passes through the housing 101 of the handheld power tool 100—is rotated or moved, the coupling mechanism can be actuated as soon as the safety elements 92 that prevent unintentional actuation have been unlatched. The safety elements 92 are configured here in the form of rocking levers placed against the housing cage 90. When the coupling mechanism is actuated by means of the control wheel 91, the housing cage 90 can be rotated or moved against the resistance of the rocking lever. For this purpose, the rocking levers installed on the housing of the handheld power tool are pushed towards the housing and away from the control wheel 91.

Diverging from the symbolic depiction in FIGS. 2A, 2B, in the case of the adaptive tangential striking mechanism 10A of FIGS. 3A, 3B, the first spring 81 here is an inner spring that rests against a stop 83.1 affixed to the spindle 20 and that is pre-tensioned relative to the main mass 71. In contrast, the second spring 82 here is an outer spring that rests against a stop 83.2 that is formed by the rear wall of the housing cage 90 and that is pre-tensioned relative to the extra mass 72. Therefore, when the housing cage 90 is rotated and moved along the guiding link, the extra mass 72 as well as the extra spring 82 are coupled to the main mass 71 or to the first spring 81 in order to form the hammer 70 and the spring system 80.

The ring-shaped main mass 71 and the extra mass 72 are arranged partially concentrically with respect to each other here. In the second operating state, the extra mass 72 surrounds the main mass like a ring and with a positive fit, while the main mass 71 is guided by the guiding contour of a link guide on the spindle 20.

The tangential striking mechanism 10A is fastened here to the housing 101 of the handheld power tool 100 by means of screwed connections 107. For this purpose, the screwed connections 107 hold a bearing block 108 that encompasses the bearing 109 for the spindle 20 on the drive side.

In the first embodiment of an adaptive tangential striking mechanism 10A according to the first refined variant of the invention shown in FIGS. 3A, 3B, it is provided that the extra mass 72 has a striking surface 74 on a hammer cam 75 thereupon, as can be seen in the cross-sectional view I of FIG. 3B, whereby, when the main mass 71 and the extra mass 72 are in the coupled state, said striking surface 74 extends axially beyond an axial extension of the main mass 71, or else—in a modification—it can also extend to the same height of the main mass 71. Consequently, here, at least the striking surface 74 of the extra mass 72—and in a modification, the striking surface of the main mass 71—serves to strike against an anvil surface on an anvil cam 63.

Both the main mass 71 and the extra mass 72 can also have suitable cams 73 with a striking surface 74 for the execution of a tangential impact on the anvil 60. According to the first embodiment of an adaptive tangential striking mechanism 10A described here, the striking surface 74 can be formed by a cam 75 of the extra mass 72 or—in the modification—by a cam 73 of the main mass as well as by a cam 75 of the extra mass 72. Precisely in the latter case, the total available striking surface 74 for the tangential impact on the anvil 60 is increased, so that during the tangential impact, the torque peak transmission is spread over a relatively large surface area. This ultimately leads to less wear of the cams 73, 75 of the main mass 71 and of the extra mass 72.

In a slightly modified embodiment, the striking surface of the cam 75 of the extra mass 72 protrudes slightly with respect to the cam 73 of the main mass, so that only the cam 75 of the extra mass 72 has contact with the anvil 60 during the tangential impact. In both modifications, the main mass 71 and the extra mass 72 are joined with a positive fit by means of the described coupling mechanism. Both the main mass 71 and the extra mass 72 as well as the first spring 81 and the second spring 82 are available for the torque transmission surface during the tangential impact in the second operating mode shown in FIG. 3B. This correspondingly increases the torque that can be generated with the tangential striking mechanism 10A. Owing to the second spring 82, the triggering torque of the tangential striking mechanism is also increased. This increase, however, stays within a relatively narrow range, so that the ease of handling of the handheld power tool 100 with the adaptive tangential striking mechanism 10 is practically not affected at all.

Figure 4A:
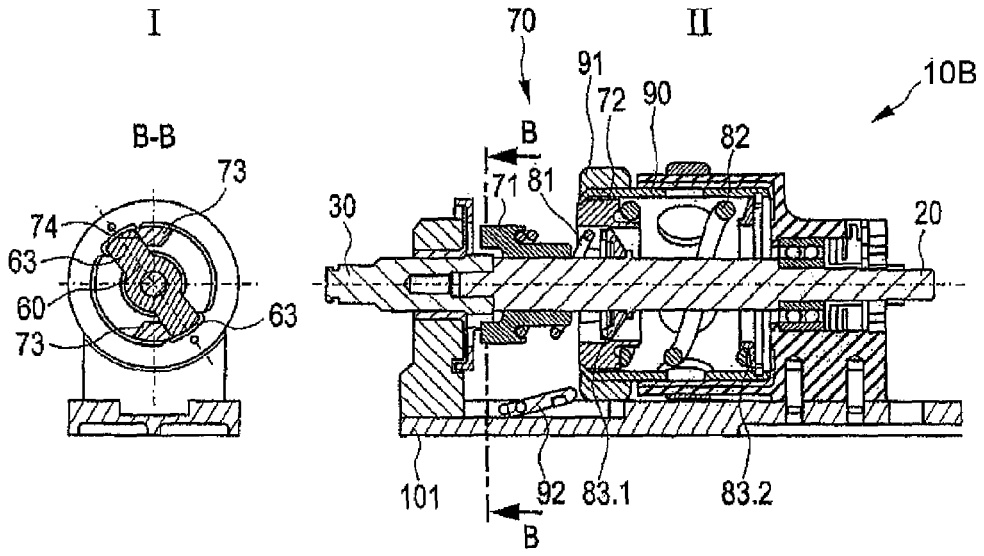
FIG. 4A, 4B: a second, structurally implemented preferred embodiment of a tangential striking mechanism according to the second refined variant of the invention, in an axial depiction and in a cross sectional depiction as well as for a first and second operating state.
Figure 4B:
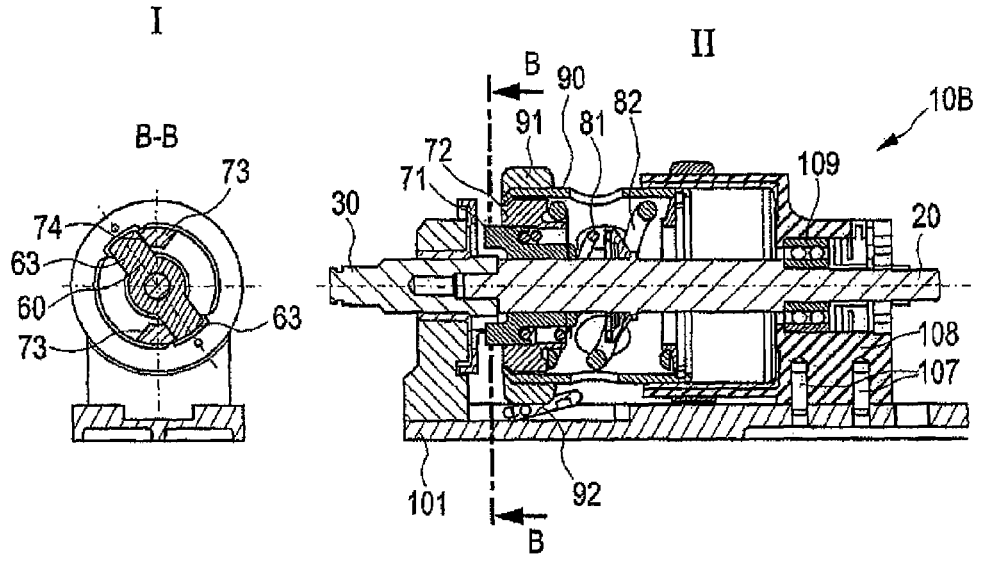

FIGS. 4A, 4B show a second embodiment of an adaptive tangential striking mechanism 10B in a depiction analogous to the one in FIGS. 3A, 3B. For the sake of simplicity, the same reference numerals are used here for identical or similar parts or for parts having an identical or a similar function. The structure of the adaptive tangential striking mechanism 10B is largely similar to that of the adaptive tangential striking mechanism 10A. Below, reference will only be made to the differences between the two tangential striking mechanisms.

The main difference can be seen by comparing the cross-sectional depiction I in FIGS. 4A and 4B. According to the second refined variant of the invention, in the second embodiment of the adaptive tangential striking mechanism 10B, it is provided that the main mass 71 has a striking surface 74 or a cam 73 that only—that is to say, in the first operating state shown in FIG. 4A as well as in the second operating state shown in FIG. 4B—has contact with the anvil 60 during the tangential impact. In other words, the main mass 71 and the extra mass 72, which can be coupled together concentrically and with a positive fit, are only fitted with the two cams 73 of the main mass 71. The extra mass 72 has no cams. The overall result is that the striking surfaces of the anvil 60 can be configured with smaller dimensions. The entire spring-mass system of the adaptive tangential striking mechanism 10B can also be configured with less weight.

Concretely speaking, the main mass here has a weight M1=135 g and the extra mass 72 has a weight M2=120 g. In other words, here, the extra mass 72 weighs less than the main mass. Correspondingly, the moment of inertia difference between the main mass and the extra mass is not as large as in the case of the adaptive tangential striking mechanism 10A. The moment of inertia $I_1$ of the main mass is about 40,000 $gmm^2$. The moment of inertia $I_2$ of the extra mass is about 75,000 $gmm^2$. The spring stiffness that gives rise to the spring constant K1 of the first spring has been selected here as 11 KN/m. The spring stiffness that gives rise to the spring constant K2 of the second spring has been selected here as 24 KN/m. In the case of the adaptive tangential striking mechanism 10A as well as of the adaptive tangential striking mechanism 10B in the spring system, the second spring constant K2 is therefore larger than the first spring constant K1. In both cases, the preferred striking frequency of the adaptive tangential striking mechanism 10A, 10B, that is to say, the natural frequency of the total spring-mass system, is about the same in the first and second operating states.

Figure 5A:
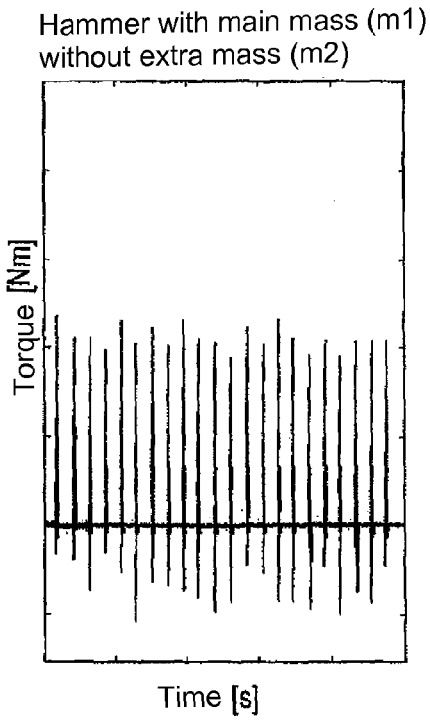
FIG. 5: a torque measured by way of an example, as a function of the time following the actuation of the tangential striking mechanism when the screw anchor is screwed into a hard substrate—in view A using the handheld power tool with the tangential striking mechanism in a first operating state, and in view B in a second operating state, with an increased total weight of the hammer and increased spring force of the tangential striking mechanism, according to the concept of the invention.
Figure 5B:
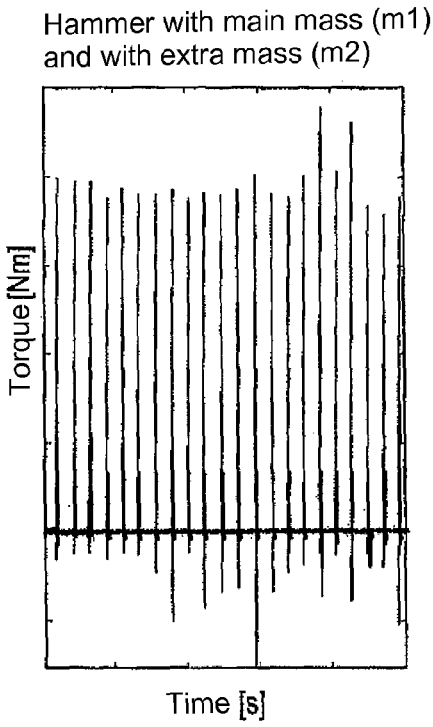

FIG. 5 shows—in the same scale—the torque peaks that have been transmitted over the same time period between the hammer 70 and the anvil 60 in an adaptive tangential striking mechanism 10A or 10B. View A shows that the average value of a transmitted torque peak in the first operating state is only about half the average value of a transmitted torque peak in the second operating state. In the first operating state, only the main mass 71 of the hammer 70 is moved so as to strike the anvil 60 tangentially only under the effect of the force of the first spring 81, when the hammer is rotated. In the second operating state, the main mass 71 and the extra mass 72 of the hammer 70 are moved so as to strike the anvil 60 axially under the effect of the force of the first and second springs 81, 82, and so as to strike the anvil 60 tangentially when the main mass is rotated. The depictions also show that the striking frequency of an adaptive tangential striking mechanism 10A, 10B in the first and second operating states is largely the same and fairly constant.

The selection of the weights M1, M2, of the moments of inertia $I_1$, $I_2$ and of the stiffness values K1, K2 described here are not restricted in any manner whatsoever to the above-mentioned values. Rather, measurements as presented in FIG. 5, have demonstrated that the average values for the torque peaks in the first and second operating modes are variable relative to each other and nevertheless, the striking frequency in the first and second operating modes can be kept the same. Towards this end, the weights M1, M2, the corresponding moments of inertia $I_1$, $I_2$ and the stiffness values K1, K2 can be chosen appropriately and, in particular, they can differ from the above-mentioned values.

What is claimed is:

1. A handheld power tool comprising:

a tangential striking mechanism drivable by a drive;

a drive shaft;

a tool socket on the drive shaft capable of holding a tool, the drive shaft capable of executing a rotating and partially tangentially striking movement by the tangential striking mechanism, the tangential striking mechanism having an anvil associated with the drive shaft as well as a hammer associated with the drive, the anvil and hammer being movable with respect to each other so as to strike each other axially when under the effect of the force of at least one first spring, and so as to strike each other tangentially when the anvil and the hammer are rotated, the hammer having a main mass; and an extra mass under the effect of the force of a second spring and detachably couplable to the main mass.

2. The handheld power tool as recited in claim 1 wherein, in a first operating state, the main mass of the hammer and the anvil are movable with respect to each other so as to strike each other axially only under the effect of the force of the first spring, and so as to strike each other tangentially when the main mass is rotated.

3. The handheld power tool as recited in claim 1 wherein, in a second operating state, the main mass and the extra mass of the hammer and the anvil are movable with respect to each other so as to strike each other axially only under the effect of the force of the at least one first spring and a second spring, and so as to strike each other tangentially when the main mass is rotated.

4. The handheld power tool as recited in claim 1 wherein the extra mass is detachably couplable to the main mass by a coupling mechanism, the coupling mechanism including a second spring acting upon the extra mass.

5. The handheld power tool as recited in claim 4 wherein the coupling mechanism has a housing cage in which the second spring is pre-tensioned against the extra mass and the housing cage.

6. The handheld power tool as recited in claim 1 wherein the coupling mechanism is movable along a guiding link.

7. The handheld power tool as recited in claim 6 wherein the coupling mechanism is axially movable or rotatable by a user.

8. The handheld power tool as recited in claim 1 wherein, in a second operating state, the main mass and the extra mass are coupled to each other with a positive fit.

9. The handheld power tool as recited in claim 1 wherein the extra mass has a striking surface that, when the extra mass and the main mass are coupled together, extends axially up to or beyond an extension of the main mass so as to stop against an anvil striking surface.

10. The handheld power tool as recited in claim 1 wherein the main mass has a striking surface that, when the extra mass and the main mass are coupled together, extends axially beyond an extension of the extra mass so as to stop against an anvil striking surface.

11. The handheld power tool as recited in claim 1 wherein the extra mass is detachably couplable to the main mass by a coupling mechanism and wherein, in a first operating state, the coupling mechanism is secured against moving by a securing element.

12. The handheld power tool as recited in claim 1 wherein weights of the main mass and the extra mass and stiffness values of the at least one first spring and a second spring are configured in such a way that a resonance frequency of the tangential striking mechanism remains similar in a first and second operating state.

13. The handheld power tool as recited in claim 1 wherein drive is a force transmitting striking drive for the tangential striking mechanism that acts upon the hammer and/or the anvil, and via the force-transmitting striking drive, the hammer and/or the anvil can be moved with respect to each other along a guiding contour so as to strike each other axially, and so as to strike each other tangentially when a guiding contour is rotated.

14. The handheld power tool as recited in claim 1 wherein the drive includes a motor and/or a transmission.

15. An impact screwdriver comprising:

a tangential striking mechanism drivable by a drive;

a drive shaft;

a tool socket on the drive shaft capable of holding a screwdriver, the drive shaft capable of executing a rotating and partially tangentially striking movement by the tangential striking mechanism, the tangential striking mechanism having an anvil associated with the drive shaft as well as a hammer associated with the drive, the anvil and hammer being movable with respect to each other so as to strike each other axially when under the effect of the force of at least one first spring, and so as to strike each other tangentially when the anvil and the hammer are rotated, the hammer having a main mass; and an extra mass under the effect of the force of a second spring and detachably couplable to the main mass.

* * * * *